United States Patent [19]

Cassia

[11] 4,131,044

[45] Dec. 26, 1978

[54] CUT-OFF MECHANISM FOR PAPER TOWEL DISPENSER

[75] Inventor: Antonio M. Cassia, La Milan, Italy

[73] Assignee: Steiner American Corporation, Salt Lake City, Utah

[21] Appl. No.: 834,404

[22] Filed: Sep. 19, 1977

[30] Foreign Application Priority Data

May 2, 1977 [IT] Italy ..... 49217 A/77

[51] Int. Cl.[2] ..... B26D 5/26

[52] U.S. Cl. ..... 83/205; 83/208; 83/223; 83/587

[58] Field of Search ..... 83/203, 205, 224, 587, 83/586, 208, 223

[56] References Cited

U.S. PATENT DOCUMENTS

| | | | |
|---|---|---|---|
| 630,863 | 8/1899 | Crowell | 83/208 |
| 1,993,951 | 3/1935 | Ashe | 83/208 |
| 2,622,681 | 12/1952 | Durst | 83/208 |

*Primary Examiner*—J. M. Meister

*Attorney, Agent, or Firm*—Vogel, Dithmar, Stotland, Stratman & Levy

[57] ABSTRACT

A cut-off mechanism is provided in a dispenser for dispensing a web of paper towel from a supply roll thereof, the cut-off mechanism including a flat cam member fixedly secured to the dispenser feed roller for rotation therewith and a drive member having a generally cylindrical portion cooperating with the cam member to form a chamber for a spiral coiled spring secured between the drive member and the dispenser feed roller so that rotation of the latter with respect to the former during dispensing of the web winds the spring. The drive member is connected by linkage to a movable cutting blade and is also provided with a stop surface which is engageable with a latch member normally to hold the movable blade motionless during winding of the spring. The cam member engages the latch to release the drive member after a predetermined length of web has been dispensed to drive the cutting member, by unwinding of the wound spring, into cooperation with a fixed blade substantially to sever the dispensed web from the supply roll. A cam portion on the drive member engages the latch member to release the cam member after the cutting operation.

19 Claims, 11 Drawing Figures

20
2
43
40
30
31
59
39
44
41
36
35
52
50
53
56
55
54
57
28
21
22
46
60
74
37
42
58
81
80
30
87
86
78
76
77
31
89
85
75
66
105
67
84
90
102
88
91
82
64
103
104
62
25
70
92
101
48
34
59

CUT-OFF MECHANISM FOR PAPER TOWEL DISPENSER

BACKGROUND OF THE INVENTION

The present invention relates to a dispenser for dispensing a web of paper towel from a supply roll thereof and, more particularly, to a cut-off mechanism for severing the dispensed portion of the web from the supply roll at the end of a dispensing operation.

A typical prior art paper towel dispenser is disclosed in U.S. Pat. No. 3,408,125 issued to H. Rasmussen on Oct. 29, 1968. In such a dispenser, the user grasps a protruding edge of the towel web and manually pulls it to unwind a length of towel from the supply roll. In the Rasmussen dispenser, after a predetermined length of web has been dispensed, the user pulls the web upwardly against a serrated cutting edge to sever the dispensed web from the supply roll. After cut-off, a time-stop mechanism actuates an internal feed mechanism for advancing the web so as to project the leading end thereof a short distance out of the dispenser for access by the user for the next dispensing operation.

It has been found that the manual tearing-type cut-off utilized in the Rasmussen device was unsuitable because it frequently resulted in uneven or only partial severing of the dispensed web and, frequently, users would prematurely attempt to sever the web before the predetermined length thereof had been dispensed, thereby aborting the operation of the internal feed mechanism. Thus, there was no protruding leading end for the next user to grasp.

This difficulty was somewhat alleviated in dispensers of the type disclosed in U.S. Pat. No. 3,739,965, issued June 19, 1973 to P. W. Jespersen et al. and U.S. Pat. No. 1,449,062, issued on Mar. 20, 1923 to H. E. Schroeder. In both of these latter devices, the web is dispensed between two feed rollers, one of which carries a radially extending cutting knife and the other of which is provided with a radial slot for receiving the knife, so that once during each revolution of the rollers the web will be severed. But in this type of cut-off apparatus, the knife has a tendency to wedge the paper web into the slot rather than cleanly severing it, thereby causing the mechanism to jam.

Other types of gravity or spring-actuated cut-off mechanisms are disclosed in the U.S. Pat. No. 3,221,586, issued to E. B. Bahnsen on Dec. 7, 1965, U.S. Pat. No. 2,333,108, issued to A. P. Krueger et al. on Nov. 2, 1943 and U.S. Pat. No. 345,052 issued July 6, 1886 to H. H. Harrison. But in each of these latter three types of cut-off mechanisms, the movable cutting blade must be cocked, i.e., it is in motion during the dispensing operation. More particularly, the blade must be moved from a starting position in two directions, in one direction to a cocked position and then back through the starting position and in the opposite direction therefrom to the cut-off position. Thus, the distance the blade must travel and the space necessary to accommodate blade travel is unnecessarily large.

SUMMARY OF THE INVENTION

In the present invention there is provided a unique cut-off mechanism for a paper towel dispenser which is of economical construction and which avoids the shortcomings of the prior art devices.

More particularly, it is an important feature of the present invention to provide a cut-off apparatus for a paper towel dispenser which includes a movable cutting member which is maintained motionless during the web dispensing operation, and which is driven to sever the web only after web travel has ceased.

It is another feature of this invention that the cut-off apparatus includes an energy storage means which accumulates and stores energy during the web dispensing operation and releases that energy to drive the cutting member after the web travel has ceased.

Still another feature of this invention is the provision of a movable cutting member which is separated from the dispenser feed roller and which automatically severs the dispensed web without any additional force being exerted by the user.

Another feature of this invention is the provision of a cut-off apparatus which includes novel cam and latch means to control the winding and unwinding of a spiral coiled spring which drives the movable cutting member.

It is another feature of this invention to provide a paper towel dispenser which includes a cut-off apparatus of the character described.

The foregoing features are obtained and it is an important object of this invention to attain these advantages by providing cutting apparatus for use in a dispenser for dispensing a web of paper towel from a supply roll thereof and having a feed roller rotatable during dispensing of the web, the cutting apparatus comprising a cutting member mountable on the dispenser for movement between a normal rest position and a cutting position for cutting the associated web between a dispensed portion and the supply roll thereof, drive means adapted to be coupled to the feed roller and to the cutting member for effecting movement thereof between the rest and cutting positions thereof, and latch means mountable on the dispenser for cooperation with the drive means normally to retain the cutting member in the rest position thereof, the latch means and the drive means being responsive to rotation of the feed roller through a predetermined angle during dispensing of the associated web for actuating the drive means to effect movement of the cutting member between the rest and cutting positions thereof.

Further features of the invention pertain to the particular arrangement of the parts of the cutting apparatus whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figures 1, 2:
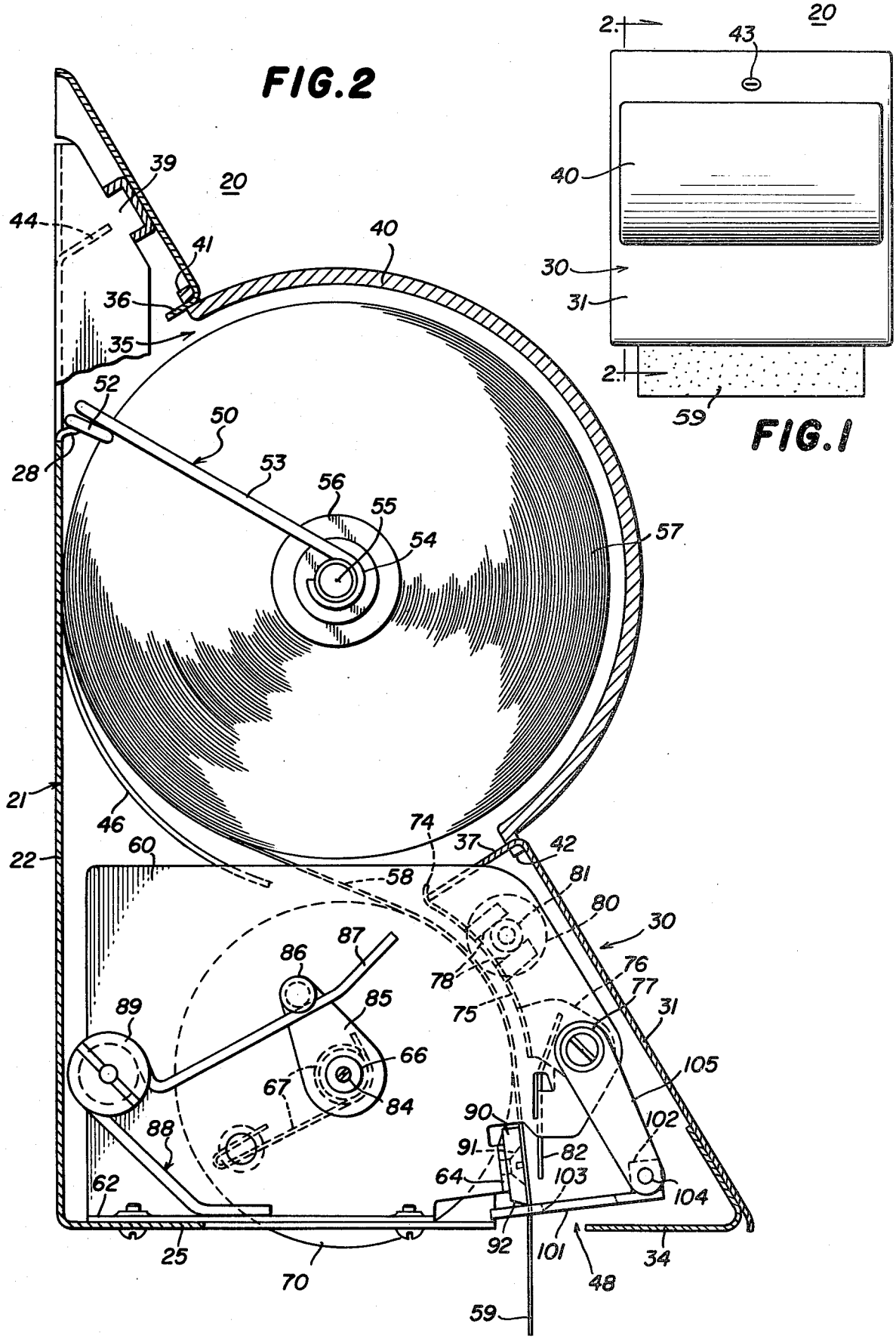
FIG. 1 is a front elevational view of a paper towel dispenser constructed in accordance with and embodying the features of the present invention.
FIG. 2 is an enlarged view in vertical section taken along the line 2—2 in FIG. 1, and illustrating a portion of the cutting apparatus of the present invention.
Figure 3:
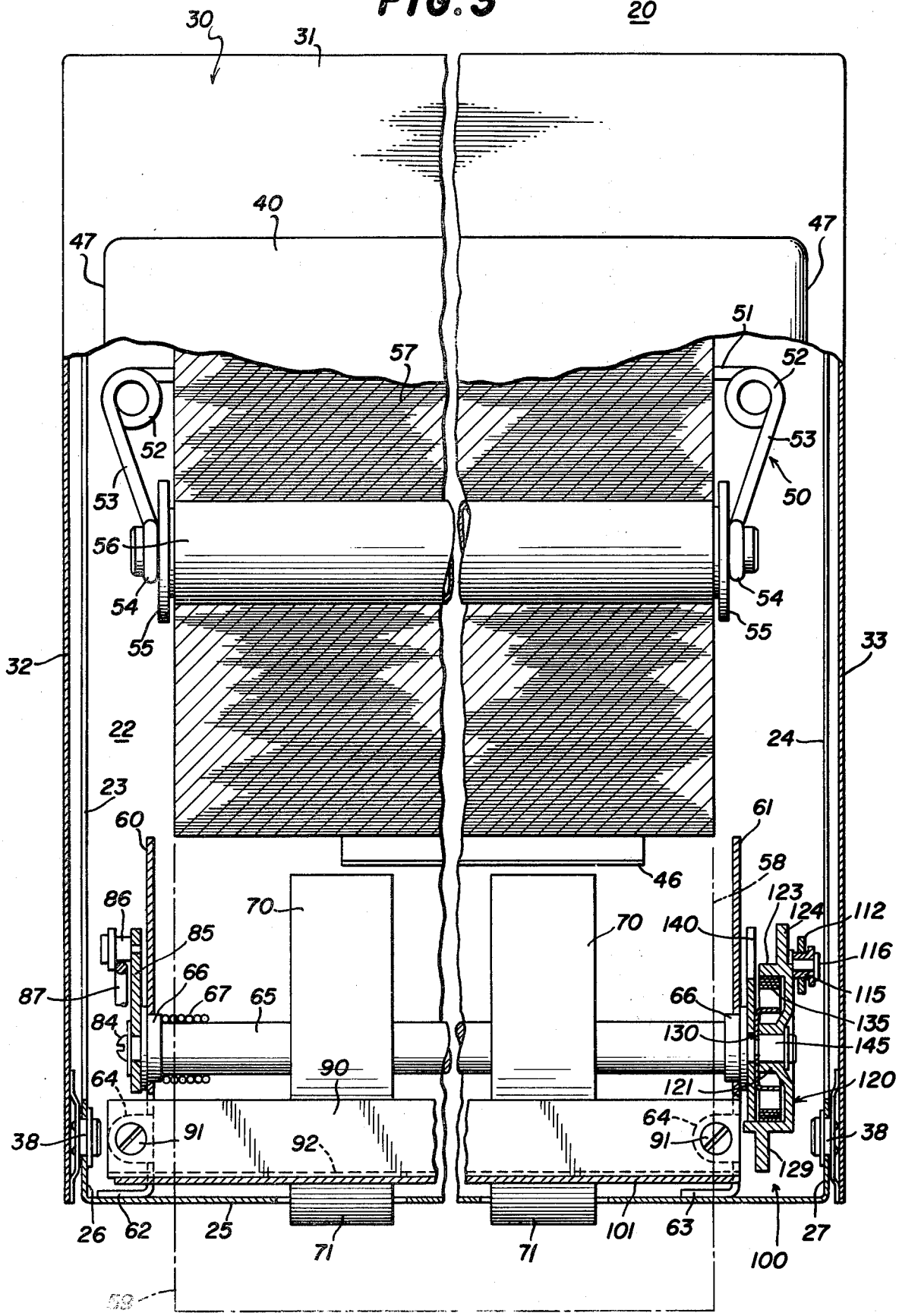
FIG. 3 is a fragmentary front elevational view of the paper towel dispenser illustrated in FIG. 2, with portions of the dispenser broken away more clearly to illustrate the internal construction thereof.

Referring now to FIGS. 1 through 3 of the drawings, there is illustrated a paper towel dispenser, generally designated by the numeral 20, which includes a cabinet or housing having a main frame, generally designated by the numeral 21, which is preferably formed of sheet metal. The frame 21 includes an upstanding rectangular rear wall 22 integral along the side edges thereof with forwardly extending short side flanges 23 and 24 and integral along the bottom edge thereof with a forwardly extending generally rectangular bottom wall 25. The bottom wall 25 is integral along the side edges thereof with upstanding short side flanges 26 and 27. Cut from the rear wall 22 adjacent to the upper end thereof and extending forwardly therefrom are a plurality of mounting tabs 28 (one shown), for a purpose to be described more fully below.

Hingedly mounted on the frame 21 is a cover, generally designated by the numeral 30, which includes a generally rectangular front panel 31 integral along the side edges thereof respectively with generally triangular side panels 32 and 33. Secured to the front panel 31 along the bottom edge thereof and extending rearwardly therefrom is a bottom flange 34. Formed in the front panel 31 is a large rectangular opening 35 bounded along the upper edge thereof with a rearwardly extending upper flange 36 and along the lower edge thereof with a rearwardly extending lower flange 37. Respectively extending laterally inwardly from the side panels 32 and 33 adjacent to the lower front ends thereof are short pivot pins 38 adapted to be received in complementary openings in the side flanges 26 and 27 of the frame 21 for pivotally mounting the cover 30 to the frame 21 for movement between an open position and a closed position, illustrated in FIGS. 1 through 3, wherein the cover 30 is inclined rearwardly from the front edge of the bottom wall 25 to the upper edge of the rear wall 22 and rests against suitable stop members 39 on the frame side flanges 23 and 24.

A generally semicylindrical window panel 40 is integral at the opposite ends thereof with generally semicircular side walls 47, all dimensioned for insertion into the opening 35 for closure of same. More particularly, the window panel 40 is provided with peripheral radially outwardly extending flanges 41 and 42 which are provided with slots therein for respectively receiving therethrough the upper and lower flanges 36 and 37 of the front panel 31, securely to hold the window panel 40 in place. Thus, it will be appreciated that the cover 30 in the closed position thereof cooperates with the frame 21 to form a closed housing. If desired, a lock 43 may be mounted in the front panel 31 at the top end thereof for cooperation with a latch flange 44 extending forwardly from the rear wall 22 to lock the cover 30 in the closed position thereof. Preferably suitable openings (not shown) are provided in the rear wall 22 for receiving associated fasteners therethrough securely to mount the dispenser 20 on a wall or other support surface. It will be noted that when the cover 30 is in the closed position thereof, the front edge of the frame bottom wall 25 is spaced a predetermined distance from the rear edge of the cover bottom flange 34 to define a dispensing opening 48.

Mounted within the dispenser 20 is a mounting bracket, generally designated by the numeral 50, which is preferably formed of an elongated metal rod which includes a rear bar portion 51 supported on the tabs 28 of the rear wall 22 and connected at the opposite ends thereof by coiled corner portions 52 with forwardly and downwardly extending mounting arms 53, respectively integral at the distal ends thereof with hook portions 54. The hook portions 54 are adapted to be respectively secured to hub members 55 which are in turn respectively received in the opposite ends of an elongated cylindrical roll spool 56 on which a web 58 of paper towel is wound to form a supply roll 57, the leading or outer end of the web 58 being designated by the numeral 59. The supply roll 57 is dimensioned to be accommodated beneath the window panel 40 of the closed cover 30, with the roll 57 being urged by gravity downwardly against a downwardly and forwardly extending arcuate guide flange 46, which is cut from the rear wall 22.

Respectively disposed a short distance inwardly of the side flanges 26 and 27 substantially parallel thereto are two upstanding side plates 60 and 61, which are respectively provided with laterally outwardly extending bottom flanges 62 which are fixedly secured by suitable means to the bottom wall 25 of the frame 21. Respectively extending laterally outwardly from the forward edges of the side plates 60 and 61 are short mounting tabs 64. The side plates 60 and 61 are provided with coaxial openings therethrough which are respectively fitted with bushings 66 in which are rotatably mounted the opposite ends of an elongated cylindrical main shaft 65 having a torsion spring 67 wound around one end thereof and anchored to the side plate 60, as indicated in FIGS. 2 and 3. Fixedly secured to the main shaft 65 for rotation therewith are two laterally spaced-apart generally cylindrical feed rollers 70, each having a ribbed outer surface 71 which may be formed of rubber or the like.

Extending between the side plates 60 and 61 adjacent to the front ends thereof and substantially parallel to the main shaft 65 is a pivot shaft 77 on which are pivotally mounted a pair of pivot arms 76 of a generally part-cylindrical metal apron 75 which extends upwardly from the pivot arms 76 and is provided at the upper end thereof with an outturned lip or flange 74. Integral with the apron 75 and extending forwardly and upwardly therefrom are laterally spaced-apart pairs of mounting brackets 78 on which are rotatably mounted the opposite ends of a pinch roller shaft 81, having fixedly secured thereto for rotation therewith a pair of pinch rollers 80, which are respectively accomodated in complementary openings in the apron 75. The pinch rollers 80 are respectively disposed for alignment with the feed rollers 70, and the apron 75 is adapted for pivotal movement between a use position illustrated in FIG. 2 and a threading position (not shown) pivoted forwardly in a clockwise direction, as viewed in FIG. 2, about the axis of the pivot shaft 77. Thus, when the apron 75 is in the use position illustrated in FIG. 2, the pinch rollers 80 are respectively disposed for cooperation with the feed rollers 70 for pinching therebetween the towel web 58, as will be explained more fully below.

Fixedly secured to one end of the main shaft 65 outboard of the side plate 60, as by a screw 84, is a lever arm 85 provided at the distal end thereof with a roller 86. The roller 86 is disposed for engagement with a leaf 87 of a leaf spring 88 which is secured to a support member 89 on the side plate 60, with the opposite end of the leaf spring 88 bearing against the bottom wall 25 of the frame 21.

Spanning the side plates 60 and 61 at the lower front portions thereof is an elongated, generally rectangular fixed knife blade 90, the opposite ends of which are respectively fixedly secured to the mounting tabs 64 by means of suitable fasteners 91, the lower edge of the knife blade 90 defining a beveled cutting edge 92.

In use, a new supply roll 57 of paper toweling is loaded in the dispenser 20 by opening the cover 30 and pivoting the apron 75 forwardly to the threading position. The leading end 59 of the towel web 58 is then fed between the feed rollers 70 and the pinch rollers 80, and thence in front of the fixed knife blade 90 and out through the dispensing opening 48. The apron 75 is pivoted back to the use position illustrated in FIG. 2, wherein the pinch rollers 80 respectively cooperate with the feed rollers 70 to pinch therebetween the towel web 58. When the cover 30 is reclosed, the distal edge of the lower flange 37 engages the lip 74 of the apron 75 firmly to urge the pinch rollers 80 toward the feed rollers 70 to assure a secure pinching of the towel web 58 therebetween and prevent any slippage of the towel web 58.

A user grasps the leading end 59 of the towel web 58 protruding from the dispensing opening 48 and manually pulls it to dispense a predetermined length of the towel web 58, this dispensing motion serving frictionally to rotate the feed rollers 70 and the main shaft 65, which in turn rotates the lever arm 85 in a clockwise direction, as viewed in FIG. 2, thereby cocking the leaf 87 of the leaf spring 88.

Referring now also to FIGS. 4 through 11 of the drawings, there is illustrated a cutting apparatus, generally designated by the numeral 100. The cutting apparatus 100 includes an elongated movable cutting blade 101 which is provided at the opposite ends thereof with upstanding mounting lugs 102 and has a tapered rearwardly extending cutting edge 103. Respectively journaled in the mounting lugs 102 are the opposite ends of an elongated pivot shaft 104. The end of the shaft 104 adjacent the side plate 60 extends beyond the associated mounting lug 102 and is pivotally connected to a mounting arm 105 adjacent to one end thereof, the other end thereof being pivotally connected to the adjacent end of the pivot shaft 77 for supporting one end of the movable cutting blade 101. Fixedly secured to the other end of the movable cutting blade 101 is a guide bracket 106 (see FIGS. 4, 5 and 11), provided with a laterally outwardly extending guide flange 107, the underside of which is disposed for engagement with and is urged upwardly by the distal end of a resilient guide finger 108 which is fixedly secured to the bottom wall 25 of the frame 21.

The end of the pivot shaft 104 adjacent to the guide bracket 106 is pivotally connected to the distal end of a short arm 111 of a bell crank lever, generally designated by the numeral 110, which is pivotally connected to the adjacent end of the pivot shaft 77, the bell crank lever 110 having an elongated rearwardly extending arm 112 provided with an elongated slot or opening 113 therein. Thus, it will be appreciated that the movable cutting blade 101 is pivotally supported by the mounting arm 105 and bell crank lever arm 111, with the rearward end of the movable cutting blade 101 being disposed immediately beneath the fixed knife blade 90 and urged into engagement therewith by the resilient guide finger 108. Thus, as the pivot shaft 77 is rotated in a counterclockwise direction, as viewed in FIGS. 4 and 5, the movable cutting blade 101 is moved rearwardly and the tapered cutting edge 103 thereof cooperates with the cutting edge 92 of the fixed knife blade 90 to shear the towel web 58 extending therebetween.

Received in the slot 113 of the bell crank lever arm 112 is a cam lug 115 which is secured by a suitable fastener 116 to a drive wheel, generally designated by the numeral 120. The drive wheel 120 includes a generally cylindrical inner hub portion 121 (see FIGS. 3 and 7) integral at one end thereof with a radially outwardly extending annular wall 122, which is in turn integral along the outer edge thereof with a generally cylindrical outer flange portion 123 which is arranged substantially coaxially with the hub portion 121. The cam lug 115 is fixedly secured to the annular wall 122 adjacent to the outer edge thereof. Integral with the cylindrical outer flange 123 and extending radially outwardly therefrom along a predetermined arc of the circumference thereof is a stop flange 122 having a radially extending stop surface 125 and a circumferentially extending guide surface 126. Also integral with the cylindrical flange 123 and extending radially outwardly therefrom and generally diametrically opposed to the stop flange 124 is a cam flange 127 having an outer cam surface 128 thereon. Integral with the cylindrical flange 123 and extending rearwardly therefrom axially thereof substantially from the stop surface 125 to the adjacent end of the cam flange 127 is a stop flange 129 (see FIG. 10).

The cutting apparatus 100 is also provided with a generally cup-shaped hub member 130 which includes a generally circular end wall 131 having a circular opening 132 extending therethrough centrally thereof and being integral along the outer edge thereof with an axially extending cylindrical flange 133. Formed in the flange 133 and end wall 131 are two diametrically opposed slots 134.

The main shaft 65 is provided at the right-hand end thereof, as viewed in FIG. 3, with a generally rectangular projection 148 (see FIG. 7) which extends outwardly beyond the side plate 61 and is received through a complementary opening in the center of a disc-like cam member 140, which is generally circular in shape and is provided with a cam finger 141 extending generally radially outwardly from one portion of the circumference thereof. The cam finger 141 is provided with a radially extending front stop surface 142 and a radially extending rear stop surface 143. The cam member 140 is also provided with a pair of generally axially extending lugs (not shown) adapted to be respectively received in the slots 134 of the hub member 130.

More particularly, in assembly of the cutting apparatus 100 the cam member 140 is mounted on the rectangular projection 148 for rotation therewith and the end wall 131 of the hub member 130 is placed in parallel back-to-back relationship against the outer surface of the cam member 140 with the lugs thereof respectively received in the slots 134 so that the main shaft 65, the cam member 140 and the hub member 130 will rotate together as a unit. A stub shaft 145 is received through the cylindrical hub portion 121 of the drive wheel 120, the stub shaft 145 having a reduced diameter portion 146 which is received in the central opening 132 of the hub member 130 and abuts against the end of the rectangular projection 148 of the main shaft 65 and is preferably coupled thereto by suitable means. The drive wheel 120 is so mounted as to be rotatable independently of the main shaft 65.

Figure 10:
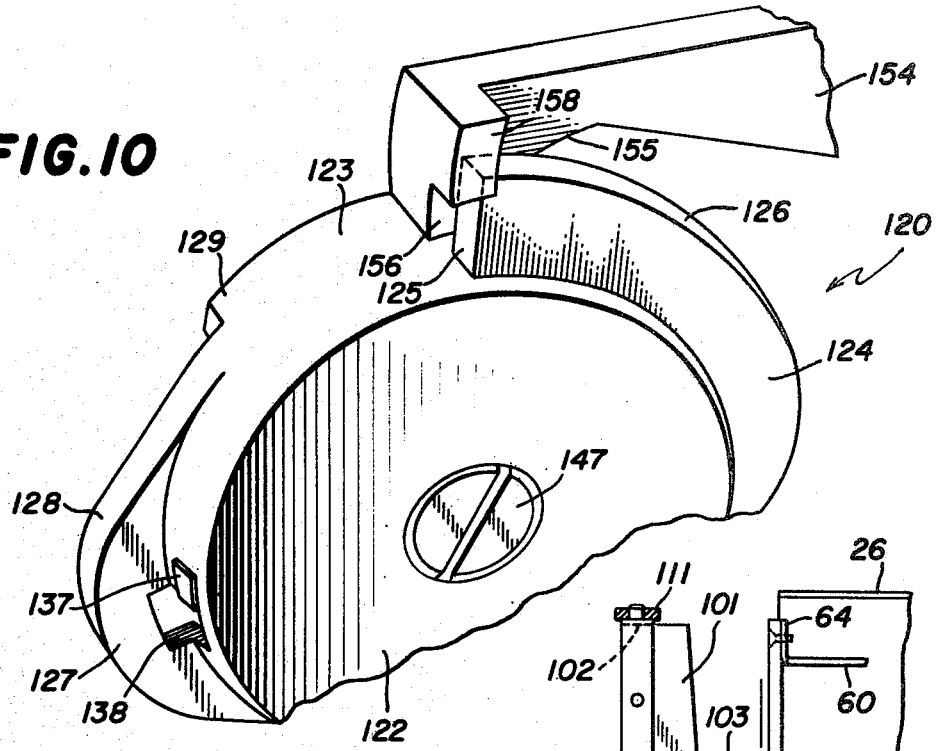
FIG. 10 is a still further enlarged fragmentary perspective view of a portion of the cutting apparatus illustrated in FIGS. 4 through 9.
Figure 11:
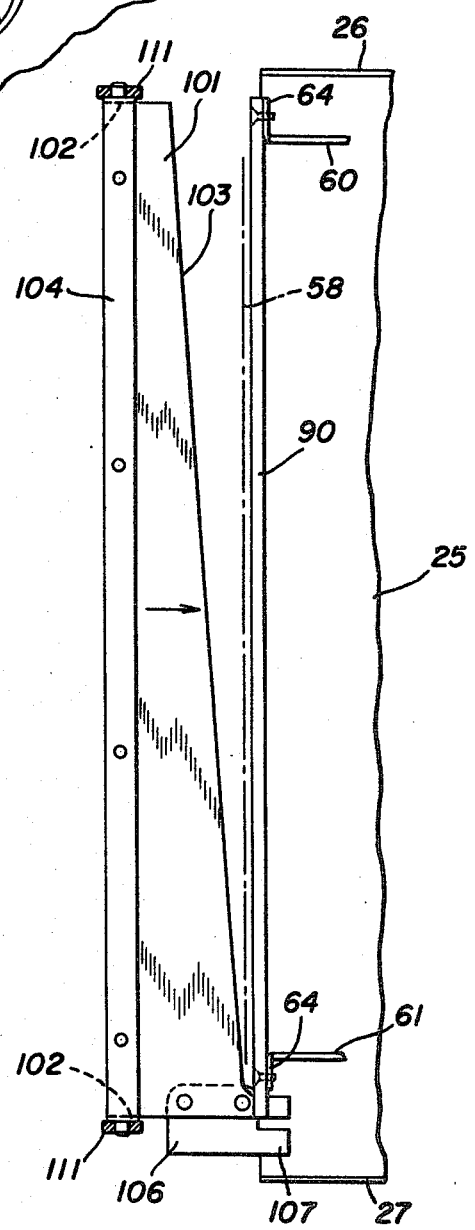
FIG. 11 is a fragmentary view in horizontal section taken along the line 11—11 in FIG. 6, illustrating the movable cutting member.

It will be noted that the parts are assembled with the cylindrical flange 133 of the hub member 130 extending outwardly for cooperation with the inwardly extending cylindrical flange 123 of the drive wheel 120 to define therebetween an annular chamber for receiving therein a spiral coiled spring 135 which has the inner end 136 thereof anchored in one of the slots 134 in the hub member 130 and the outer end 137 thereof anchored in an opening 138 in the cylindrical outer flange 123 of the drive wheel 120 (see FIG. 10).

Figure 6:
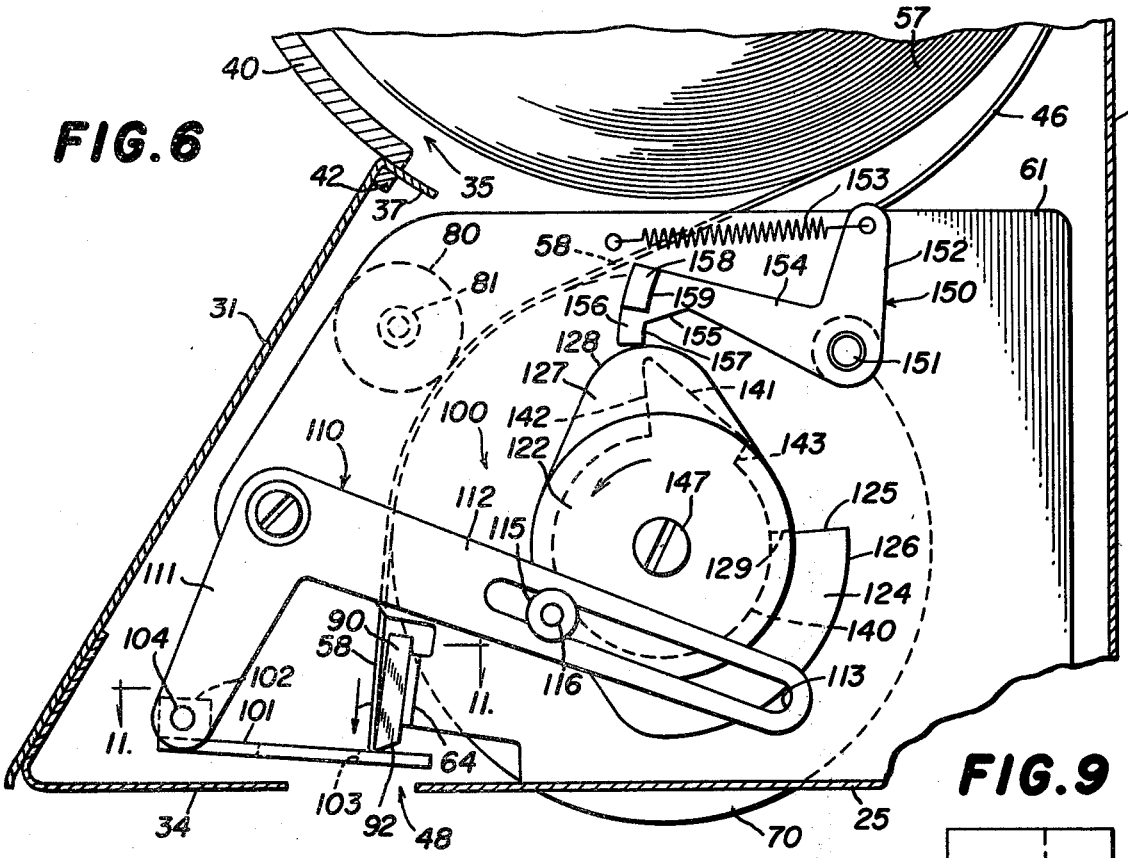
FIG. 6 is a view similar to FIG. 4, illustrating the cutting apparatus disposed in a position immediately after the severing of the dispensed web.

A latch dog, generally designated by the numeral 150, is pivotally mounted via a pivot pin 151 to the side plate 61, the latch dog 150 having a short arm 152 which is connected to one end of a helical tension spring 153, the other end of which is anchored to the side plate 61, resiliently to urge the latch dog 150 toward rotation about the pivot pin 151 in a counterclockwise direction, as viewed in FIG. 6. The latch dog 150 is also provided with an elongated arm 154 extending substantially parallel to the side plate 61 and being provided with a cam surface 155 along the bottom thereof which joins a stop surface 157 on a lower latch finger 156. The latch dog 150 is also provided with an upper latch finger 158 which extends outwardly therefrom generally perpendicular to the plane of the side plate 61 above the lower latch finger 156 and is provided with a stop surface 159.

Figure 7:
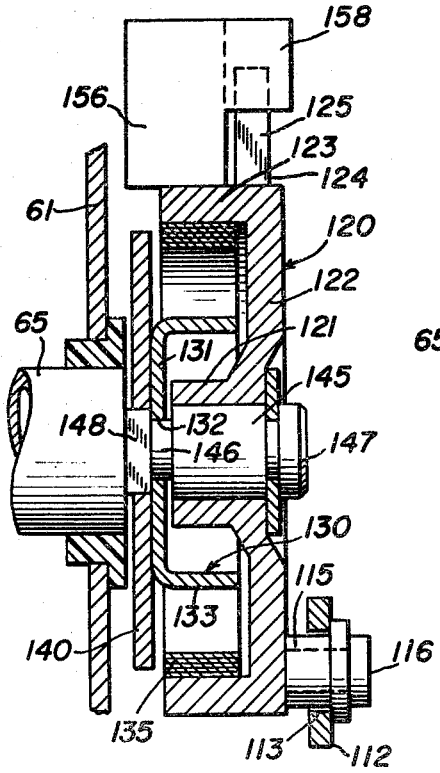
FIG. 7 is a further enlarged view in vertical section taken along the line 7—7 in FIG. 4.
Figure 8:
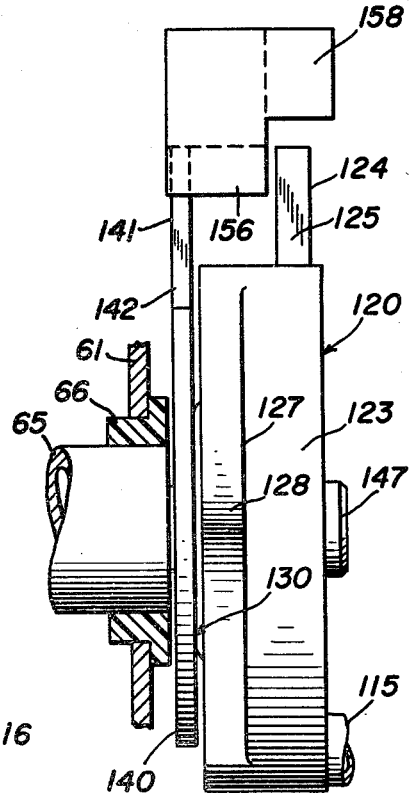
FIG. 8 is a view similar to FIG. 7, illustrating the cutting apparatus in the position shown in FIG. 5 and with portions of the apparatus shown in elevation.
Figure 9:
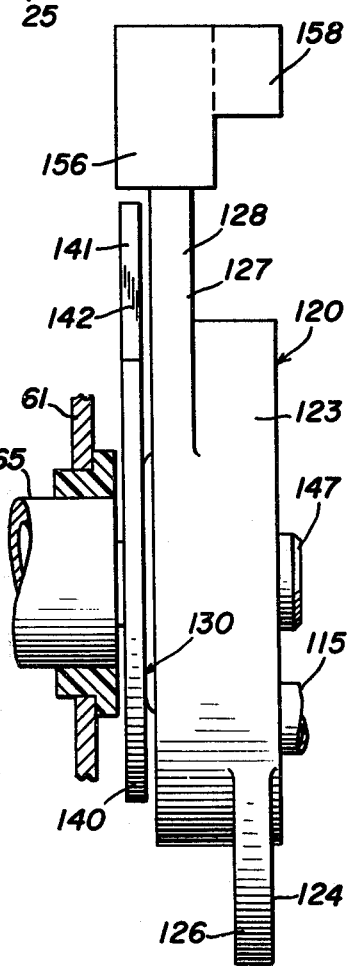
FIG. 9 is a view similar to FIG. 8, illustrating the cutting apparatus in the position shown in FIG. 6.

Referring to FIGS. 7 through 9 of the drawings, it can be seen that the lower latch finger 156 is pivotally movable into and out of the paths of rotation of the cam finger 141 of the cam member 140 and the cam flange 127 of the drive wheel 120, while the upper latch finger 158 is pivotally movable into and out of the path of rotation of the stop flange 124.

Figure 4:
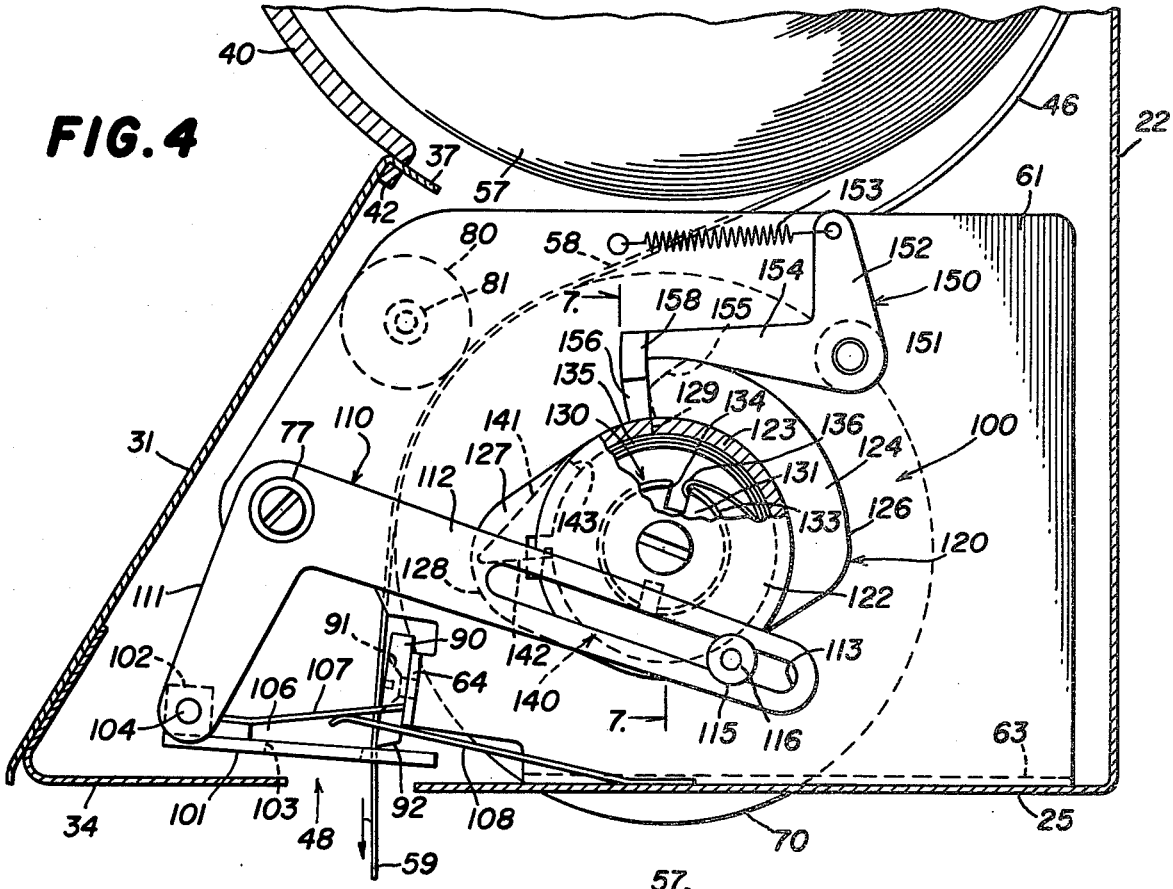
FIG. 4 is a fragmentary view of the lower portion of the dispenser illustrated in FIG. 3, as viewed from the right-hand side thereof, with the side cover of the dispenser broken away and with the cutting apparatus disposed in a starting configuration.

In operation, the cutting apparatus 100 is normally disposed in the starting configuration illustrated in FIGS. 4 and 7, at the beginning of a dispensing operation. The towel web 58 extends in front of the fixed knife blade 90 and behind the tapered cutting edge 103 of the movable cutting blade 101 and thence outwardly through the dispensing opening 48, with the leading edge 59 thereof projecting far enough to be grasped by a user. A user pulls the leading end 59 of the towel web 58, which results in rotation of the feed rollers 70 and the main shaft 65 in a counterclockwise direction, as viewed in FIG. 4, the cam member 140 and the hub member 130 rotating with the main shaft 65. The drive wheel 120 does not rotate, since it is restrained from rotation in the counterclockwise direction by engagement of the stop surface 159 of the upper latch finger 158 with the stop surface 125 of the stop flange 124 on the drive wheel 120. Thus, the hub member 130 will rotate with respect to the drive wheel 120, causing a winding or tightening of the coiled spring 135.

Figure 5:
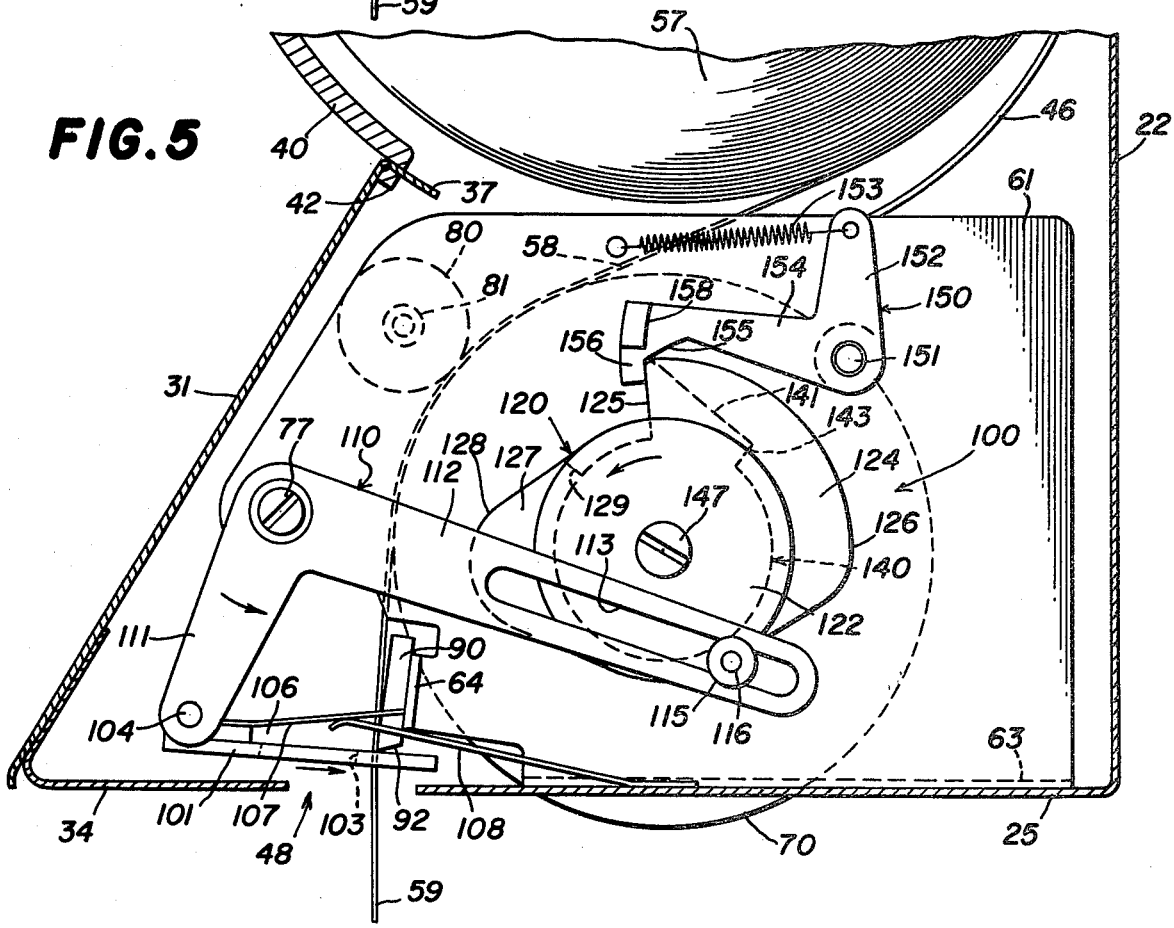
FIG. 5 is a view similar to FIG. 4, with the cutting apparatus disposed in an intermediate position at the beginning of the movement of the movable cutting member.

As the user continues to pull the towel web 58 from the dispenser 20, the cam member 140 will continue to rotate toward the position illustrated in FIGS. 5 and 8. As it approaches this position, the cam finger 141 is brought into camming engagement with the cam surface 155 of the latch dog 150, thereby pivoting it in a clockwise direction, as viewed in FIG. 5, against the urging of the tension spring 153, for lifting the upper latch finger 158 out of engagement with the stop surface 125 of the stop flange 124. The lifting of the latch dog 150 will continue until the front stop surface 142 of the cam finger 141 engages the stop surface 157 of the lower latch finger 156, thereby restraining the cam member 140 and the main shaft 65 from further rotation.

While the dispensing of the web 58 is thus stopped, the drive wheel 120 is released by the lifting of the latch dog 150 and, by reason of the unwinding action of the wound coiled spring 135, is rotated in a counterclockwise direction, as viewed in FIG. 5, toward the position illustrated in FIGS. 6 and 9. As the spring 135 unwinds, the cam finger 141 may tend to back up slightly along the cam surface 155 allowing the latch dog 150 to lower somewhat, whereupon the upper latch finger 158 may ride along the guide surface 126 of the stop flange 14. As the drive wheel 120 rotates, the cam lug 115 pivots the bell crank lever 110 in a counterclockwise direction, as viewed in FIG. 5, thereby moving the movable cutting blade 101 in the direction of the arrow in FIG. 5 under the guiding action of the guide flange 107 and resilient guide finger 108, for cooperation of the tapered cutting edge 103 with the cutting edge 92 of the fixed knife blade 94 to sever the dispensed portion of the towel web 58. As the cam lug 115 passes through the top of its circular path, it will slide along the slot 113 toward the pivot end of the arm 112 and then, as the lug 115 continues to rotate downwardly, it will pivot the bell crank lever 110 back in a clockwise direction, as viewed in FIG. 5, for returning the movable cutting blade 101 to its rest position, as illustrated in FIG. 6.

As the movable cutting blade 101 is thus being retracted to its rest position, the cam surface 128 of the cam flange 127 is brought into camming engagement with the lower latch finger 156, which rides up along the cam surface 128 and is lifted thereby to the release position illustrated in FIG. 6, wherein the stop surface 157 is disengaged from the stop surface 142 of the cam finger 141, thereby permitting continued rotation of the main shaft 65. At this point, the drive wheel 120 and cam member 140 will be oriented with respect to each other in substantially the same relationship as they were in the starting configuration illustrated in FIG. 4, each of them having been separately rotated through approximately 270 degrees from the starting position, and it remains only to move both of them back through approximately 90 degrees to that starting position. Since both the drive wheel 120 and the cam member 140 have rotated through approximately the same angle, the coiled spring 135 should be substantially unwound during the rotation of the drive wheel 120. But in order to insure that the drive wheel 120 does not rotate past the position illustrated in FIG. 6, at substantially the same time as the latch dog 150 is lifted to its uppermost position by the cam flange 127, the stop flange 129 is brought into engagement with the rear stop surface 143 of the cam finger 141 to prevent further counterclockwise rotation of the drive wheel 120 with respect to the cam member 140.

Referring to FIG. 2, it will be noted that while the main shaft 65 was rotating through approximately 270 degrees during the dispensing operation, the lever arm 85 is rotated thereby in a clockwise direction, as viewed in FIG. 2, thereby cocking the leaf 87 of the leaf spring 88 downwardly. When the cutting apparatus 100 is disposed in the position illustrated in FIG. 5, the lever arm 85 will have moved to a position wherein the longitudinal axis thereof, which passes through the centers of the main shaft 65 and roller 86, will have been moved just past a position normal to the longitudinal axis of the leaf 87. Therefore, when the cam member 140 and main shaft 65 are released by the action of the cam flange 127, the cocked spring leaf 87 will drive the lever arm 85 back upwardly in a clockwise rotational direction to the starting position illustrated in FIGS. 2 and 4, thereby rotating the cam member 140 and drive wheel 120 simultaneously from the position illustrated in FIG. 6 to the starting position illustrated in FIG. 4, with the cam lug 115 sliding downwardly along the slot 113 toward the distal end of the lever arm 112 substantially without movement of the movable cutting blade 101. As the main shaft 65 is thus rotated back to the starting configuration under the urging of the spring leaf 87, another short length of towel web 58 is dispensed by the feed rollers 70 through the dispensing opening 48 so as to be accessible to the next user of the dispenser 20. It will be noted that, should the towel web 58 be released by the user before the main shaft 65 has rotated to the stop position of FIG. 5, backup of the main shaft 65 under the urging of the leaf spring 87 is prevented by tightening of the torsion spring 67.

While the parts of the cutting apparatus 100 may be formed of any material suitable for performing the intended functions, preferably the drive wheel 120 and latch dog 150 are formed of a synthetic organic resin such as that sold under the trademark "DELRIN", while the bell crank lever 110 and movable cutting blade 101 and fixed knife blade 90 are formed of suitable metals. Preferably, the cabinet or housing of the dispenser 20 is formed of sheet metal, with the exception of the window panel 40 which is preferably formed of a transparent or translucent plastic material so that the amount of paper towel left on the supply roll 57 will be visible to a user.

From the foregoing, it can be seen that there has been provided an improved paper towel dispenser and cutting apparatus therefor which provides for automatic severing of the dispensed portion of the towel web from the supply roll thereof at the end of a dispensing operation.

More particularly, there has been provided an improved cutting apparatus of the character described, which includes a movable cutting blade which remains substantially motionless during the dispensing of the towel web.

In addition, there has been provided a cutting apparatus of the type set forth, in which energy for driving the movable cutting blade is stored during the dispensing operation and is released when the predetermined length of towel web has been dispensed for effecting severing of the dispensed towel web.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. Cutting apparatus for use in a dispenser for dispensing a web of paper towel from a supply roll thereof and having a feed roller rotatable during dispensing of the web, said cutting apparatus comprising a cutting member mountable on the dispenser for movement between a normal rest position and a cutting position for cutting the associated web between a dispensed portion and the supply roll thereof, drive means adapted to be coupled to the feed roller and to said cutting member for effecting movement thereof between the rest and cutting positions thereof, and latch means mountable on the dispenser for cooperation with said drive means normally to retain said cutting member in the rest position thereof during dispensing of the associated web, said latch means and said drive means being responsive to rotation of the feed roller through a predetermined angle during dispensing of the associated web for actuating said drive means to effect movement of said cutting member from the rest position to the cutting position thereof and then back to the rest position thereof.

2. The cutting apparatus set forth in claim 1, wherein said cutting member is adapted so that movement thereof from the rest position to the cutting position thereof substantially severs the dispensed portion of the associated web from the supply roll thereof.

3. The cutting apparatus set forth in claim 1, wherein said drive means is effective, when actuated, for moving said cutting member from the rest position to the cutting position thereof and then back to the rest position thereof.

4. The cutting apparatus set forth in claim 1, wherein said predetermined angle is approximately 270 degrees.

5. Cutting apparatus for use in a dispenser for dispensing a web of paper towel from a supply roll thereof and having a feed roller rotatable during dispensing of the web, said cutting apparatus comprising a cutting member mountable on the dispenser for movement between a normal rest position and a cutting position for cutting the associated web between a dispensed portion and the supply roll thereof, energy storage means adapted to be coupled to the feed roller and responsive to rotation thereof during dispensing of the associated web for accumulating and storing energy, drive mechanism coupled to said energy storage means and to said cutting member for effecting movement thereof between the rest and cutting positions thereof, latch means mountable on the dispenser for cooperation with said drive mechanism normally to retain said cutting member in the rest position thereof during dispensing of the associated web and accumulation and storage of energy by said energy storage means, said latch means and said drive mechanism being responsive to rotation of the feed roller through a predetermined angle during dispensing of the associated web for actuating said energy storage means and said drive mechanism to effect release of the stored energy to said drive mechanism for movement of said cutting member from the rest position to the cutting position thereof and then back to the rest position thereof.

6. The cutting apparatus set forth in claim 5, wherein said energy storage means comprises a spiral coiled spring having one end thereof fixed with respect to the feed roller and the other end thereof fixed with respect to said drive mechanism so that movement of the feed roller with respect to said drive mechanism winds said spring.

7. The cutting apparatus set forth in claim 5, wherein said drive mechanism includes a rotating member coupled to said energy storage means and adapted for rotation independently of the feed roller in response to release of the stored energy in said energy storage means, and a pivoting member mounted on the dispenser and coupled to said rotating member and to said cutting member for driving said cutting member in response to rotation of said rotating member.

8. Cutting apparatus for use in a dispenser for dispensing a web of paper towel from a supply roll thereof and having a feed roller rotatable during dispensing of the web, said cutting apparatus comprising a cutting member mountable on the dispenser for movement between a normal rest position and a cutting position for cutting the associated web between a dispensed portion and the supply roll thereof, a cam member fixedly mountable on the feed roller for rotation therewith from a starting position, a drive member mountable on the dispenser for rotation independently of the feed roller and having a stop surface thereon, a spiral coiled spring connected between the feed roller and said drive member for winding in response to rotation of the feed roller with respect to said drive member, a latch member mountable on the dispenser for movement between a latching position disposed for engagement with said stop surface for preventing rotation of said drive member and a release position disposed out of the path of said stop surface for accommodating rotation of said drive member, and linkage mechanism interconnecting said drive member and said cutting member and cooperating with said drive member when said stop surface is engaged with said latch member in the latching position thereof for holding said cutting member in the rest position thereof, said cam member being engageable with said latch member after rotation through a predetermined angle from the starting position during dispensing of the web for moving said latch member to the release position thereof thereby to permit rotation of said drive member by unwinding of the wound coiled spring, said linkage mechanism being responsive to rotation of said drive member for effecting movement of said cutting member between the rest and cutting positions thereof.

9. The cutting apparatus set forth in claim 8, wherein said drive member includes a generally cylindrical portion which cooperates with the feed roller and said cam member to form an enclosure for said coiled spring.

10. The cutting apparatus set forth in claim 8, wherein said latch member comprises a dog pivotally mounted on the dispenser and having a latch finger and a cam surface, said latch finger being engageable with said stop surface in the latching position of said latch member and being disposed out of the path of said stop surface in the release position of said latch member, said cam member being rotatable into camming engagement with said cam surface to effect pivotal movement of said latch member from the latching position to the release position thereof.

11. The cutting apparatus set forth in claim 8, wherein said linkage mechanism includes a pin carried by said drive member adjacent to the periphery thereof and extending therefrom substantially parallel to the axis of rotation thereof, and a bell crank lever pivotally mounted on the dispenser and having one end thereof pivotally connected to said cutting member and the other end thereof being provided with an elongated slot receiving said pin therein for effecting pivotal movement of said lever in response to rotation of said drive member.

12. The cutting apparatus set forth in claim 8, and further including a fixed blade mounted on the dispenser, and guide means carried by the dispenser and disposed for engagement with said cutting member for guiding the movement thereof between the rest and cutting positions thereof for cooperation with said fixed blade to effect a sheaing of the associated web.

13. The cutting apparatus set forth in claim 8, wherein said cam member and said drive member are mounted coaxially with the feed roller.

14. Cutting apparatus for use in a dispenser for dispensing a web of paper towel from a supply roll thereof and having a feed roller rotatable during dispensing of the web, said cutting apparatus comprising a cutting member mountable on the dispenser for movement between a normal rest position and a cutting position for cutting the associated web between a dispensed portion and the supply roll thereof, a first cam member fixedly mountable on the feed roller for rotation therewith from a starting position, a drive member mountable on the dispenser for rotation independently of the feed roller and having a stop surface thereon, a spiral coiled spring connected between the feed roller and said drive member for winding in response to rotation of the feed roller with respect to said drive member, a latch member mountable on the dispenser for movement among first and second latching positions and a release position, said latch member in the first latching position thereof being disposed for engagement with said stop surface in a starting configuration for preventing rotation of said drive member, said latch member in the second latching position thereof being disposed for engagement with said first cam member to prevent rotation thereof and out of the path of said stop surface for accommodating rotation of said drive member, said latch member in the release position thereof being disposed out of the paths of said stop surface and said cam member for accommodating rotation of both said drive member and said cam member, linkage mechanism interconnecting said drive member and said cutting member and cooperating with said drive member when said stop surface is engaged with said latch member in the first latching position thereof for holding said cutting member in the rest position thereof, said first cam member being engageable with said latch member after rotation through a predetermined angle from the starting position during dispensing of the web for moving said latch member to the second latching position thereof thereby to permit rotation of said drive member by unwinding of the wound coiled spring and to prevent further rotation of said first cam member, said linkage mechanism being responsive to rotation of said drive member for effecting movement of said cutting member between the rest and cutting positions thereof, and a second cam member carried by said drive member and engageable with said latch member after movement of said cutting member to the cutting position thereof for moving said latch member to the release position thereof thereby to permit return of said first cam member to the starting position and return of said drive member and said latch member to the starting configuration thereof.

15. The cutting apparatus set forth in claim 14, wherein said second cam member is integral with said drive member.

16. The cutting apparatus set forth in claim 14, wherein said drive member and said latch member and said second cam member are all formed of a synthetic organic resin.

17. The cutting apparatus set forth in claim 14, wherein said latch member comprises a dog pivotally mounted on the dispenser and having first and second latch fingers and a cam surface extending from said second latch finger, said first latch finger being disposed for engagement with said stop surface in the first latching position of said latch member and being disposed out of the path of said stop member in the second latching position and release position of said latch member, said first cam member being rotatable into camming engagement with said cam surface when said latch member is disposed in the first latching configuration thereof for effecting movement of said latch member to the second latching position thereof in which said first cam member is engageable with said second latch finger, said second cam member being rotatable into camming engagement with said second latch finger when said latch member is in the second latching position thereof for effecting movement thereof to the release position thereof.

18. The cutting apparatus set forth in claim 14, wherein said drive member includes a stop flange disposed in the path of said first cam member, said stop flange being rotatable with said drive member into engagement with said first cam member as said latch member is moved to the release position thereof to limit the rotation of said drive member with respect to said first cam member.

19. A dispenser for dispensing a web of paper towel from a supply roll thereof, said dispenser comprising a housing for accommodating the roll of paper towel therein and having a dispensing opening, dispensing mechanism including a feed roller rotatably mounted in said housing for dispensing the web of paper toweling from the supply roll through the dispensing opening to the exterior of said housing, a cutting member mountable on said housing for movement between a normal rest position and a cutting position for cutting the web between a dispensed portion and the supply roll thereof, drive means coupled to said feed roller and to said cutting member for effecting movement thereof between the rest and cutting positions thereof, and latch means mounted on the housing for cooperation with said drive means normally to retain said cutting member in the rest position thereof during dispensing of the associated web, said latch means and said drive means being responsive to rotation of said feed roller through a predetermined angle during dispensing of the web for actuating said drive means to effect movement of said cutting member from the rest position to the cutting position thereof and then back to the rest position thereof.

* * * * *